US006484803B1

(12) United States Patent
Gremillion

(10) Patent No.: US 6,484,803 B1
(45) Date of Patent: Nov. 26, 2002

(54) DUAL DIAMETER CENTRALIZER/SUB AND METHOD

(75) Inventor: Maximillian S. Gremillion, Missouri City, TX (US)

(73) Assignee: CaseTech International, Inc., Houston, TX (US)

( * ) Notice: Subject to any disclaimer, the term of this patent is extended or adjusted under 35 U.S.C. 154(b) by 12 days.

(21) Appl. No.: 09/655,795

(22) Filed: Sep. 6, 2000

(51) Int. Cl.[7] ..... E21B 17/10

(52) U.S. Cl. ..... 166/241.6; 166/241.1; 166/242.6

(58) Field of Search ..... 166/241.1, 241.6, 166/241.7, 242.6; 175/325.1, 325.2, 329.5

(56) References Cited

U.S. PATENT DOCUMENTS 2,258,052 A 10/1941 Hall
3,128,827 A * 4/1964 Kluck ..... 166/241.6 X
3,196,952 A * 7/1965 Solum ..... 166/241.7 X
3,237,696 A * 3/1966 Hall ..... 166/172
3,289,768 A * 12/1966 Solum ..... 166/241.6
3,556,042 A * 1/1971 Laughlin ..... 166/241.7
4,566,317 A * 1/1986 Shakra ..... 73/152.35
4,739,842 A * 4/1988 Kruger et al. ..... 175/325.2
4,880,066 A * 11/1989 Steiginga et al. ..... 175/107
4,995,456 A * 2/1991 Cornette et al. ..... 166/241.1
5,339,896 A * 8/1994 Hart et al. ..... 166/241.1
5,575,333 A * 11/1996 Lirette et al. ..... 166/241.1

* cited by examiner

*Primary Examiner*—George Suchfield
(74) *Attorney, Agent, or Firm*—Mark R. Wisner; N. Elton Dry

(57) ABSTRACT

A dual diameter centralizing sub for maintaining stand-off and/or centralizing a tubular member inside a larger diameter tubular member, for instance, in a wellbore. The centralizer is provided with bow springs that compress into grooves between radially outwardly-extending vanes that are spaced around the outer diameter of the sub when compressive force is applied to the bow springs. The vanes extend radially outwardly far enough that the effective diameter of the sub in the area of the vanes is greater than the diameter of the sub and/or the tubing to which it is mounted to provide stand-off even under conditions in which the bow springs are fully compressed.

22 Claims, 3 Drawing Sheets

DUAL DIAMETER CENTRALIZER/SUB AND METHOD

BACKGROUND OF THE INVENTION

The present invention relates to a centralizer for use in wellbore operations. More specifically, the present invention relates to a centralizer with movable bow springs, particularly a stabilizer that is used in relatively small annular spaces and which also expands for use in a larger annular space. In another aspect, the present invention relates to a centralizer that provides a minimum standoff and/or centralization in portions of a wellbore in which known bow spring centralizers cannot provide adequate standoff because the bow springs lack sufficient restoring force.

Bow spring centralizers are used to center one tubular member inside a borehole or other tubular member, e.g., to center a first smaller casing in a second larger casing. Typically, centralizers are run into the borehole on the exterior of an inner tubular member or pipe string and project radially outwardly from the outside diameter (O.D.), or surface of the smaller tubular member into contact with the inside diameter (I.D.), or surface of the larger diameter tubular. However, a disadvantage of such centralizers is that they restrict fluid flow in the annular space.

Many wells include a portion that is cased and a portion that is not cased. In other wells, the diameter of the bore changes, or the well includes one or more lateral bores. Downhole operations are conducted in cased, uncased, different diameter, and/or lateral bores. In such wellbores, the centralizer must pass through a portion of the bore that is relatively small and then down through a portion that is smaller, with the centralizing function needed in the larger diameter, deeper portion of the wellbore. So far as is known, no centralizer is available that can be run into such bores and then provide effective centralizing in a larger diameter portion of the wellbore. Similarly, no centralizer is known that provides effective centralizing in bores of both diameters.

Another limitation of known centralizers occurs in the curved portion of a wellbore. In such wellbores, the weight of the tilting or pipe to which the centralizer is mounted exceeds the restoring force of the bow springs such that the tubing or pipe bears against the side of the wellbore.

There is, therefore, a need for, and it is an object of the present invention to provide, a centralizer that positions the tubing or pipe string off the side of the wellbore in the curved portion of the wellbore.

It is also an object of the present invention to provide positive centralization in areas of the wellbore where a bow spring is not strong enough to position the pipe or tubing string off the side of the well bore but also provide standoff in less severe portions of the borehole.

Another object of the present invention is to provide a centralizer that functions in both a large and/or small diameter annulus and/or wellbore.

Another object of the present invention is to provide a centralizer that maintains both standoff from the wall of the borehole and fluid flow through the borehole.

Yet another object of the present invention is to provide a centralizer that can be run into a borehole through a borehole of small diameter, e.g., a cased portion of the borehole, that also functions to center the tubing in a portion of the borehole having a diameter larger than the small diameter portion such as an uncased portion of the borehole.

Other objects, and the advantages, of the present invention will be made clear to those skilled in the art by the following description of a presently preferred embodiment thereof.

SUMMARY OF THE INVENTION

These objects are achieved by providing a centralizer comprising a body, a plurality of radially outwardly extending vanes on the body, and a collar mounted on the body. A plurality of bow springs are mounted to the collar, the bow springs being maintained in spaced relation to the vanes whereby one or more of the bow springs moves between a first, bowed position standing off from the body to a second compressed position between the vanes and closer to the body. When the bow springs are compressed into the spaces between vanes, the vanes, which are not compressible under normal operating conditions, provide standoff from the wall of the hole and maintain fluid flow past the centralizer. In a particularly preferred embodiment, the vanes extend radially outwardly from the surface of the body of the centralizer far enough that the effective diameter of the body at the location of the vanes is larger than the diameter of the body, thereby providing the standoff from the wall of the borehole.

DETAILED DESCRIPTION OF THE PREFERRED EMBODIMENT

Figure 1:
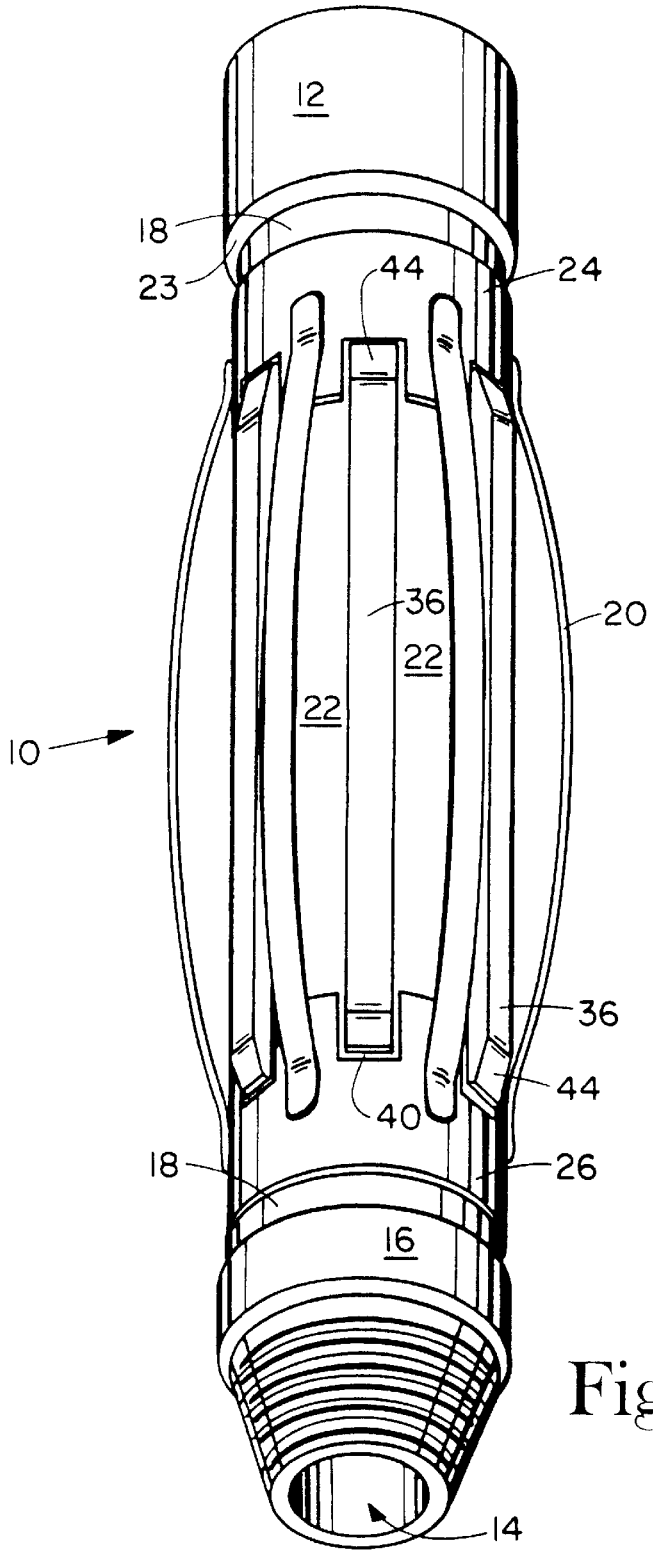
FIG. 1 is a perspective view of a preferred embodiment of a centralizer constructed in accordance with the teachings of the present invention.

Referring to FIG. 1, a preferred embodiment of the centralizer constructed in accordance with the teachings of the present invention is indicated generally at reference numeral 10. In the embodiment shown, centralizer 10 is comprised of a tubular body 12 having a bore 14 therethrough and an outer surface, or O.D., 16. The O.D. 16 of body 12 is provided with a groove 18 in which the first and second collars 24, 26 are movably disposed, the ends 28 of a plurality of bow springs 20 being affixed to each of collars 24, 26 by, for instance, welding or other suitable means of attachment. Bow springs 20 are spaced apart around the collars 24, 26. Although not shown in the figures, those skilled in the art who have the benefit of this disclosure will recognize that one or both of collars 24, 26 move apart from each other when the bow springs are moved from the first, bowed position standing off from said body as shown in FIG. 1 to a second, compressed position closer to body 12 as centralizer 10 performs its function of maintaining standoff between a tubing string and the wall of a borehole. Depending upon the bow in bow springs 20 and the spacing between the margins of collars 24, 26, the shoulder 23 marking the change in the diameter of the O.D. 16 of body 12 from the larger diameter portion to the smaller diameter of groove 18 functions as a stop that abuts one or both of collars 24, 26 when moved in response to contact between the bow springs 20 and the inside diameter of another member, e.g., a larger casing (not shown in FIG. 1 but described in detail in connection with FIGS. 5 and 6, infra).

Figure 3:
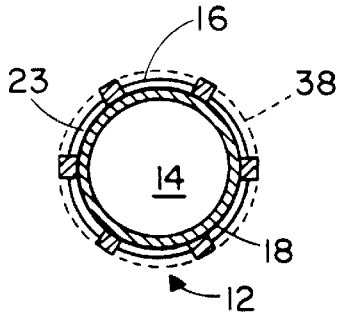
FIG. 3 is a cross-sectional view of the body of the FIG. 2 taken at the line 3—3 in FIG. 2.
Figure 2:
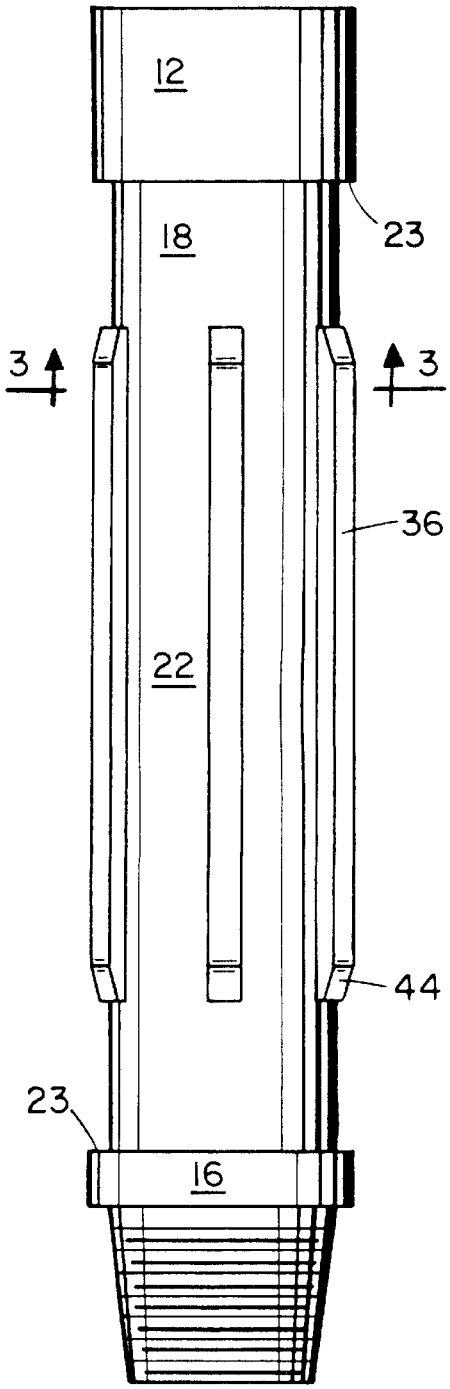
FIG. 2 is an elevational view of the body of the centralizer of FIG. 1 having the bow springs removed therefrom to show the vanes on the outside diameter of the body.

As shown in FIGS. 2 and 3, the body 12 is provided with a plurality of radially outwardly extending vanes 36 on the outside surface of body 12 in the area of groove 18. Vanes 36 may be milled into body 12 but it is preferred (for cost saving in manufacture) to weld the vanes 36 to the surface 16 of body 12. As best shown in FIG. 1, the spaces between vanes 36 provide grooves 22 for receipt of the bow springs 20 as bow springs 20 are compressed from the first, bowed position standing off from said body shown in FIG. 1 to the above-described second, compressed position closer to body 12. Although described herein as first and second positions, those who are skilled in the art will recognize from this disclosure that the designation of first and second positions for bow springs 20 is arbitrary, chosen for the purpose of facilitating the description of the grooves 22 between vanes 36, and that the position of the bow springs 20 is a continuum depending upon the degree of compression applied to bow springs 20 by contact with the inside diameter of another tubular member or a borehole. Referring now to FIG. 3, it can be seen that the vanes 36 extend radially outwardly from the surface 16 of body 12 in the area of groove 18 far enough that the effective diameter (shown in shadow line 38 in FIG. 3) of the body 12 in the area to which the vanes 36 are mounted is greater than the diameter of both (a) the portion of body 12 in the area of groove 18 and (b) the portion of body 12 above and below groove 18 for a purpose to be explained below.

Figure 4:
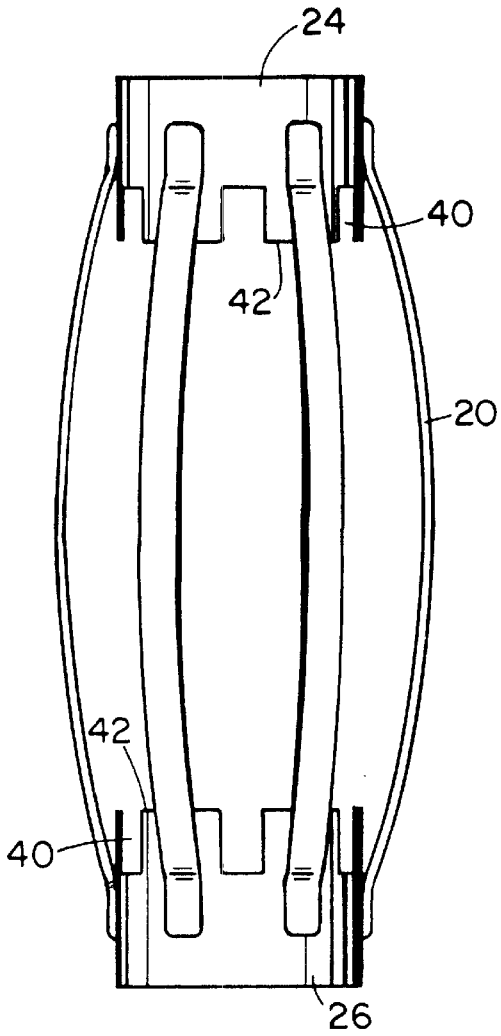
FIG. 4 is an elevational view of the bow springs of the centralizer of FIG. 1 removed from the body thereof.

As shown in FIG. 4, the collars 24, 26 to which bow springs 20 are attached are provided with a plurality of cut-outs 40 in their opposed margins 42 such that the collars 24, 26 are castellated. Referring also to FIG. 1, it can be seen that the number of cut-outs 40 spaced radially around the opposed margins 42 of collars 24, 26 is the same as the number of vanes 36 mounted to body 12 and that each cut-out 40 receives the end 44 of a respective vane 36, thereby preventing relative rotation between body 12 and the assembly comprised of the bow springs 20 and collars 24, 26. Similarly, the depth of the cut-outs 40 in collars 24, 26 is such that, when the bow springs 20 move from the first, bowed position to the second position close to the body 12 in the grooves 22 between vanes 36 and first and second collars 24, 26 move apart from each other in groove 18, the collars 24, 26 do not rotate relative to body 12. In other words, the interaction of the ends 44 of vanes 36 and the cut-outs 40 prevents relative rotational movement between body 12 and the bow spring 20/collar 24, 26 assembly when bow springs 20 are in both their first, bowed and their second, compressed positions.

Figure 5A:
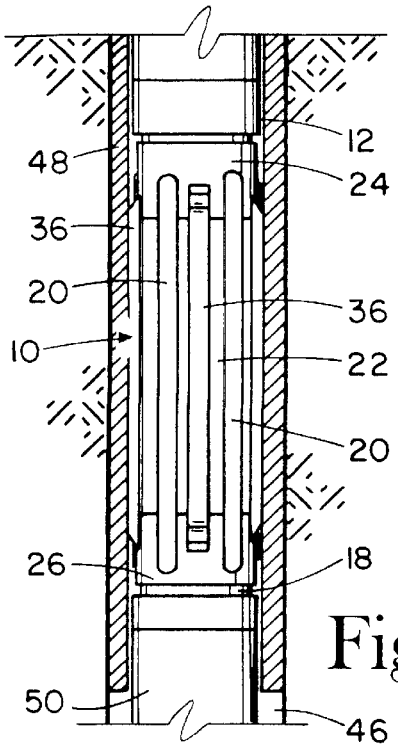
FIGS. 5A and 5B are longitudinal sectional views of a wellbore having the centralizer of FIG. 1 being run therein in casing (FIG. 5A) and without casing (FIG. 5B).
Figure 5B:
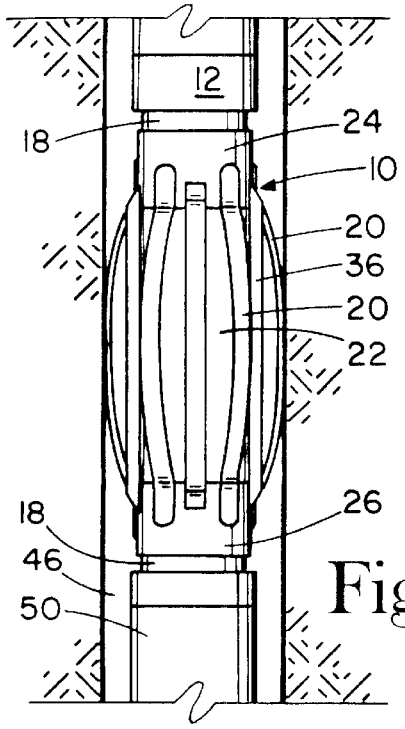

FIG. 5 shows the preferred embodiment of the centralizer 10 of the present invention being run into a cased (FIG. 5A) and uncased (FIG. 5B) borehole 46. Referring first to FIG. 5A, the bow springs 20 are compressed into the spaces 22 between vanes 36 in the area of borehole 46 that is lined with casing 48. In the portion of borehole 46 that is uncased, the bow springs 20 expand to the first, bowed position to center the tubing string 50 to which centralizer 10 is mounted in the borehole 46.

Figure 6:
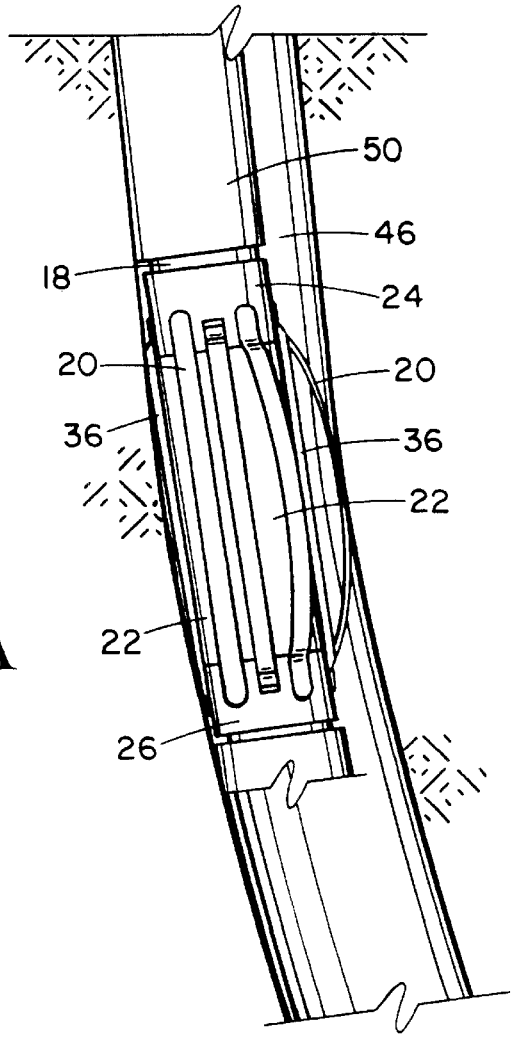
FIG. 6 is a longitudinal view of a curved portion of a wellbore having the centralizer of FIG. 1 run therein.

Referring now to FIG. 6, there is shown a curved borehole 46 (the curve is exaggerated for purposes of illustration) with a tubing string 50 therein having the preferred embodiment of the centralizer of the present invention mounted thereto. Even though the bow spring 20 is compressed into the space 22 between vanes 36 on the larger radius side of the borehole, a minimum stand-off is maintained by the bearing of the vanes 36 against the wall of the borehole on the larger radius side of borehole 46, thereby maintaining fluid flow past the centralizer 10 and reducing abrasive wear on tubing string 50. As shown by the bowed position of bow spring 20 on the shorter radius side of borehole 46, the centralizer 10 of the present invention functions to center tubing string 50 even in the curved portion of the borehole 46.

Those skilled in the art who have the benefit of this disclosure will recognize that certain changes can be made to the component parts of the apparatus of the present invention without changing the manner in which those parts function to achieve their intended result. For instance, although the vanes 36 are described herein as being welded to the outside surface 16 of body 12 of the centralizer of the present invention such that it is clear that in the presently preferred embodiment, the vanes 36 are comprised of relativley incompressible metal, those skilled in the art who have the benefit of this disclosure will recognize that vanes 36 may also be comprised of materials other than metal. Further, in certain applications, it may be advantageous to make the vanes 36 of a material that is slightly compressible or even elastically deformable when compressive forces are exerted against the vanes. A variety of polymeric materials are available, for instance, that are high temperature tolerant, or a-id resistant, or have other desirable physical properties that will enable them to serve this function. Those skilled in the art who have the benefit of this disclosure will also recognize that, although the preferred embodiment of the centralizer of the present invention has been described herein as being used in a wellbore, the use of the centralizer of the present invention is not so limited. A centralizer constructed in accordance with the teachings of the present invention may be used in any application in which it is desirable to maintain minimum standoff between two concentric tubular members and/or center one tubular member inside another.

Similarly, U.S. Pat. No. 5,575,333 discloses several embodiments of a bow spring centralizer that vary, inter alia, in the configuration of the bow springs and their attachment to the body of the centralizer. To illustrate how the structure disclosed in that patent can be incorporated into the centralizer of the present invention, one embodiment of the centralizer disclosed in that patent lacks collars altogether, the bow springs being attached directly to the outside surface of the body of the centralizer and the ends of the bow springs moving in grooves when the bow springs are compressed. Similar grooves can be provided in the surface 16 of the body 12 of the centralizer of the present invention for receiving the bow springs 20 described herein. Those skilled in the art will recognize that the other structural variations shown in that patent can also be utilized in connection with the centralizer of the present invention. For that reason, U.S. Pat. No. 5,575,333 is incorporated into this specification in its entirety by this reference thereto. Similarly, those skilled in the art will recognize that, as also described in that same U.S. Pat. No. 5,575,333, the centralizer of the present invention will function for its intended purpose with but one of the two collars 24, 26. Likewise, U.S. Pat. No. 3,556,042 discloses a bow spring centralizer in which the collar/bow spring assembly is provided with slightly-bowed so-called inner strips that connect the collars under the bow springs so that compression of the bow springs is resisted. That same patent also discloses a centralizer having a bow spring with a double arc that is used to advantage in connection with the centralizer of the present invention. Because of this disclosure, U.S. Pat. No. 3,556,042 is also incorporated into this specification in its entirety by this specific reference thereto. The alternative embodiments resulting from the incorporation of the structural features of these two patents that are incorporated herein by reference, and other changes that will be made clear to those skilled in the art by this description of the preferred embodiments of the invention, are intended to fall within the scope of the following, non-limiting claims.

What is claimed is:

1. A centralizer comprising:

a body;

a plurality of radially outwardly extending vanes on said body;

a collar mounted on said body; and a plurality of bow springs mounted to said collar, said bow springs being maintained in spaced relation to said vanes whereby one or more of said bow springs moves between a first, bowed position standing off from said body to a second compressed position between said vanes and closer to said body.

2. The centralizer of claim 1 wherein said body comprises first and second portions, the diameter of the second portion being larger than the diameter of the first portion.

3. The centralizer of claim 2 wherein said vanes extend radially outwardly far enough that the effective diameter of the body at the point to which said vanes are mounted is greater than the diameter of the second portion of said body.

4. The centralizer of claim 1 additionally comprising a second collar, said bow springs being mounted to said second collar.

5. The centralizer of claim 4 wherein said bow springs are held in spaced relationship to said vanes by the interaction of said collars with said vanes.

6. The centralizer of claim 5 additionally comprising a plurality of cut-outs on one or both of said collars for receiving one or both ends of said vanes therein.

7. The centralizer of claim 4 wherein said collars are slidably mounted on said body.

8. The centralizer of claim 1 wherein said bow springs are held in spaced relationship to said vanes by the interaction of said collar with said vanes.

9. The centralizer of claim 8 additionally comprising one or more cut-outs on said collar for receiving one end of one of said vanes therein.

10. The centralizer of claim 8 wherein said collar is slidably mounted on said body.

11. The centralizer of claim 1 wherein said vans extend radially outwardly far enough that the effective diameter of the body at the point to which said vanes are mounted is greater than the diameter of said body.

12. A centralizer comprising an elongate body having a plurality of vanes extending radially outwardly therefrom and forming a plurality of grooves therebetween, a collar mounted on said body, and a plurality of bow springs mounted to said collar, said bow springs being compressible from a first, bowed position to a second, compressed position closer to said body, said bow springs being positioned in the grooves between vanes when in the second, compressed position.

13. The centralizer of claim 12 wherein said body comprises first and second portions, the diameter of the second portion being larger than the diameter of the first portion.

14. The centralizer of claim 12 wherein said vanes extend radially outwardly far enough that the effective diameter of the body at the point to which said vanes are mounted is greater than the diameter of the second portion of said body.

15. The centralizer of claim 12 additionally comprising a second collar, said bow springs being mounted to said second collar.

16. The centralize of claim 15 wherein said bow springs are maintained in position in the grooves between said vanes by the interaction of said collars with said vanes.

17. The centralizer of claim 16 additionally comprising one or more cut-outs on one or both of said collars for receiving one or both ends of one of said vanes therein.

18. The centralizer of claim 15 wherein said collars are slidably mounted on said body.

19. The centralizer of claim 12 wherein said bow springs are held in spaced relationship to said vanes by the interaction of said collar with said vanes.

20. The centralizer of claim 19 additionally comprising one or more cut-outs on said collar for receiving one end of one of said vanes therein.

21. The centralizer of claim 19 wherein said collar is slidably mounted on said body.

22. The centralizer of claim 12 wherein said vanes extend radially outwardly far enough that the effective diameter of the body at the point to which said vanes are mounted is greater than the diameter of said body.

* * * * *